US007143688B2

(12) United States Patent
Rexhaj et al.

(10) Patent No.: US 7,143,688 B2
(45) Date of Patent: Dec. 5, 2006

(54) BINDING DEVICE

(75) Inventors: Fahredin Rexhaj, Sundsbruk (SE); Stefan Nordhälling, Matfors (SE)

(73) Assignee: Metso Paper, Inc. (FI)

( * ) Notice: Subject to any disclaimer, the term of this patent is extended or adjusted under 35 U.S.C. 154(b) by 71 days.

(21) Appl. No.: 10/521,342

(22) PCT Filed: Jul. 1, 2003

(86) PCT No.: PCT/SE03/01142

§ 371 (c)(1),
(2), (4) Date: Jan. 4, 2005

(87) PCT Pub. No.: WO2004/005135

PCT Pub. Date: Jan. 15, 2004

(65) Prior Publication Data

US 2005/0241498 A1 Nov. 3, 2005

(30) Foreign Application Priority Data

Jul. 9, 2002 (SE) ..... 0202178

(51) Int. Cl.
*B65B 13/04* (2006.01)

(52) U.S. Cl. ..... 100/26; 100/29; 100/912; 226/118.4; 53/589

(58) Field of Classification Search ..... 100/6, 100/8, 26, 29, 31, 32, 912; 53/389.1, 382, 53/589; 226/118.1, 118.4; 242/388.9, 417
See application file for complete search history.

(56) References Cited

U.S. PATENT DOCUMENTS 3,137,426 A * 6/1964 Brenneisen ..... 226/10
3,929,063 A 12/1975 Stromberg et al.
5,236,329 A * 8/1993 Sylvester ..... 53/399
5,809,873 A * 9/1998 Chak et al. ..... 100/4
6,418,838 B1 * 7/2002 Bobren et al. ..... 100/26

FOREIGN PATENT DOCUMENTS

| | | |
|---|---|---|
| DE | 200 07 232 U1 | 8/2000 |
| EP | 1 249 397 A2 | 10/2002 |
| SE | 509 532 C2 | 10/1993 |
| SE | 509 534 C2 | 6/1997 |
| SE | 0004821-5 A | 6/2002 |

* cited by examiner

*Primary Examiner*—Derris H. Banks
*Assistant Examiner*—Jimmy T. Nguyen
(74) *Attorney, Agent, or Firm*—Lerner, David, Littenberg, Krumholz & Mentlik, LLP

(57) ABSTRACT

Binding apparatus for binding wire around pulp bales are disclosed including a wire magazine, a wire feeder for feeding and stretching the wire, a guide for guiding the wire from the feeder around the pulp bale, a wire cutter and twister for cutting the wire and twisting together the wire ends and a take-up unit for taking up a loop in the wire obtained upon stretching of the wire around the pulp bale, the take-up unit including a take-up space having a pair of walls separated by a distance adapted to accept the wire but insufficient to accept a double strand of the wire, and the short sides of the take-up space separated by a distance adapted to accept a loop of the wire without being folded and the take-up space at one of the short sides including a wire guide space wider than the wire and formed by grooves in at least one of the walls.

6 Claims, 5 Drawing Sheets

BINDING DEVICE

FIELD OF THE INVENTION

The present invention relates to a device for binding wire around pulp bales, where the wire is taken from a wire magazine, preferably a coil of wire, comprising feed means for feeding and stretching the wire, guide means for guiding the wire around the object during the feed, means for cutting off the stretched wire and retaining and twisting together the wire ends, and a take-up unit for taking up the wire loop resulting from the stretching of the wire.

BACKGROUND OF THE INVENTION

Pulp bales are bound by known devices of the kind described above, and examples of such devices are described, for example, in Swedish Patent Nos. 380, 496, 509, 532 and 509, 534. As described in these publications, the free end of the wire is advanced through the means for cutting off and twisting together the wire, and is guided around the bale by guide means. When the wire reaches the means for cutting off and twisting together the wire for the second time, the feed is stopped and the wire end is caught and retained. The guide means releases the wire, and the feed means is reversed to stretch the wire around the bale, whereafter the wire is cut off, and the ends are twisted into a knot. The re-fed wire is then used in the next binding operation. The stretching of the wire yields a relatively great wire length, which must be taken up by the take-up unit. In such devices, problems often arise in that the wire entangles in the take-up unit. This results in operation breakdowns.

On of the objects of the present invention is to provide a take-up unit which has a higher operational safety and capacity and renders possible a high speed feed of the wire.

SUMMARY OF THE INVENTION

In accordance with the present invention this and other objects have now been realized by the discovery of apparatus for binding wire having a predetermined diameter around bales comprising a wire magazine for supplying the wire, a feeder for feeding and stretching the supplied wire, a guide for guiding the wire from the feeder around the bale, a wire cutter and twister for cutting the wire and twisting together the ends of the cut wire, and a take-up unit for taking up a loop in the wire obtained upon the stretching of the wire around the bale, the take-up unit comprising a longitudinally extending wire take-up space comprising a pair of long sides formed by a pair of walls and a pair of short sides, the pair of walls being separated by a first predetermined distance adapted to accept the wire having the predetermined diameter but not sufficient to accept a double strand of the wire, the pair of short sides separated by a second predetermined distance adapted to accept a loop of the wire without being folded, the longitudinally extending wire take-up space at one of the pair of short sides comprising a wire guide space which is wider than the first predetermined distance and formed by grooves in at least one of the pair of walls. Preferably, the wire take-up space has a substantially rectangular shape.

In accordance with one embodiment of the apparatus of the present invention, the bales comprise pulp bales.

In accordance with another embodiment of the apparatus of the present invention, the wire magazine comprises a coil of the wire.

In accordance with another embodiment of the apparatus of the present invention, the wire take-up space has a predetermined length sufficiently long to accommodate a plurality of successive wire loops therein.

In accordance with another embodiment of the apparatus of the present invention, the grooves in at least one of the pair of walls has a width approximately equal to the predetermined diameter and a depth of from about 0.5 to 1.5 times the predetermined diameter.

These and other objects are also achieved in principle by the take-up unit comprising a longitudinal, relatively flat space (wire take-up space), which in cross-section has a substantially rectangular shape with long sides and short sides. The distance between the long sides (width) is adapted to the wire diameter, so that the wire cannot lie double therein, and the distance between the short sides (height) is such that the wire can lie in loops between the short sides without folding. The wire take-up space has at one short side a wider portion; i.e., a groove, adapted to retain the wire when it is stretched.

BRIEF DESCRIPTION OF THE DRAWINGS

The present invention may be more fully appreciated with reference to the following detailed description which, in turn, refers to the figures, in which.

DETAILED DESCRIPTION

Figure 1:
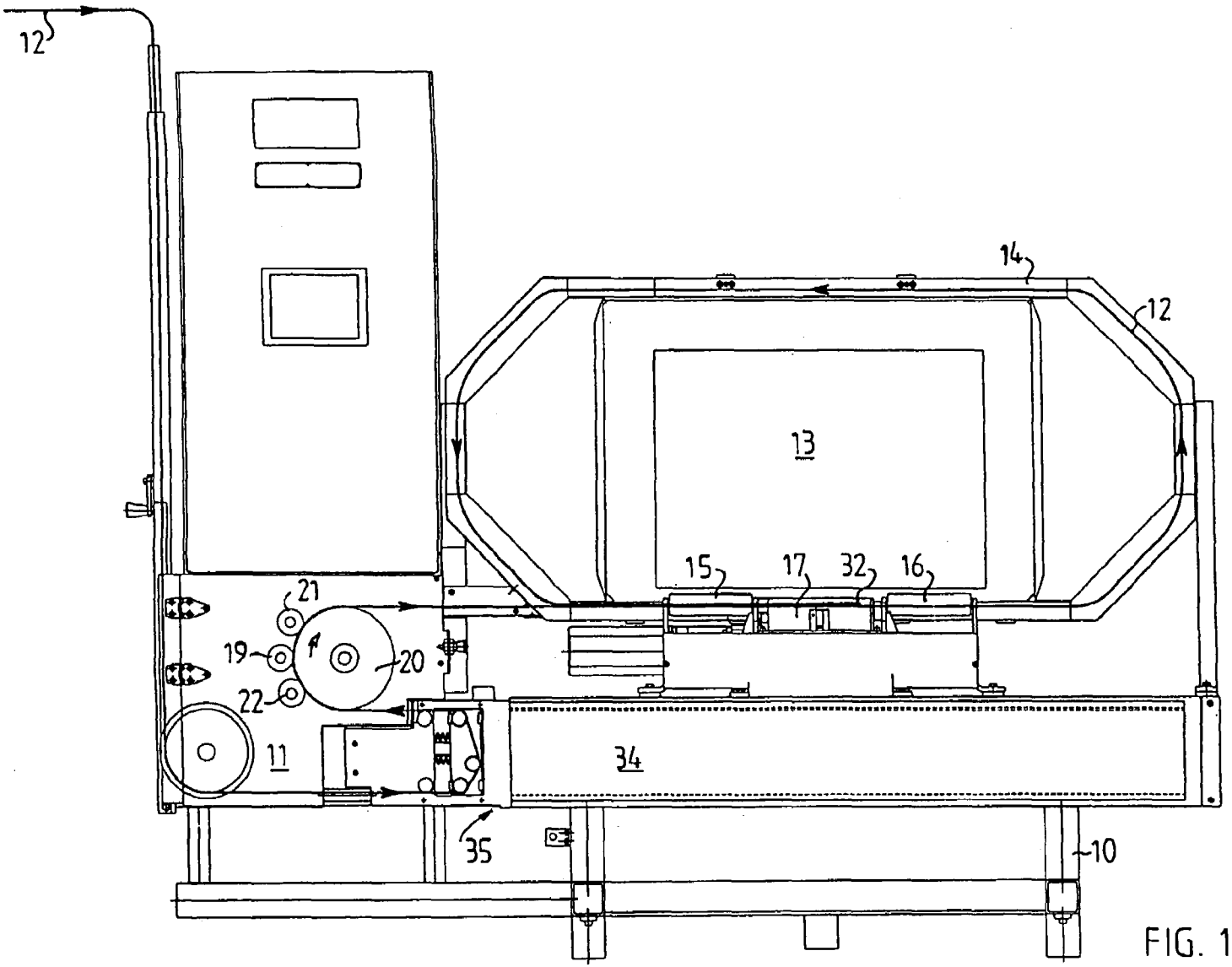
FIG. 1 is a side, elevational, partially opened view of a binding machine according to the present invention during the feeding of wire.

The binding device shown in the Figures has a stand 10, which carries a number of units for various partial operations. A feed unit 11 is provided to feed binding wire, usually steel wire, 12, with a diameter D, from a wire magazine (not shown) in the form of a coil, from which the wire is reeled off. A wire guide means in the form of a bar 14 extends about the pulp bale 13 for the wire to be bound around the bale. The pulp bale 13 is moved by bale feed conveyor, 15,16, into the guide bar 14 perpendicularly to the paper plane. A binding unit 17 comprises means for cutting off the wire, catching the wire ends and twisting the same together. The binding unit is conventional and is not shown and described in detail, but reference is made to the Swedish patent specifications mentioned above.

Figure 3:
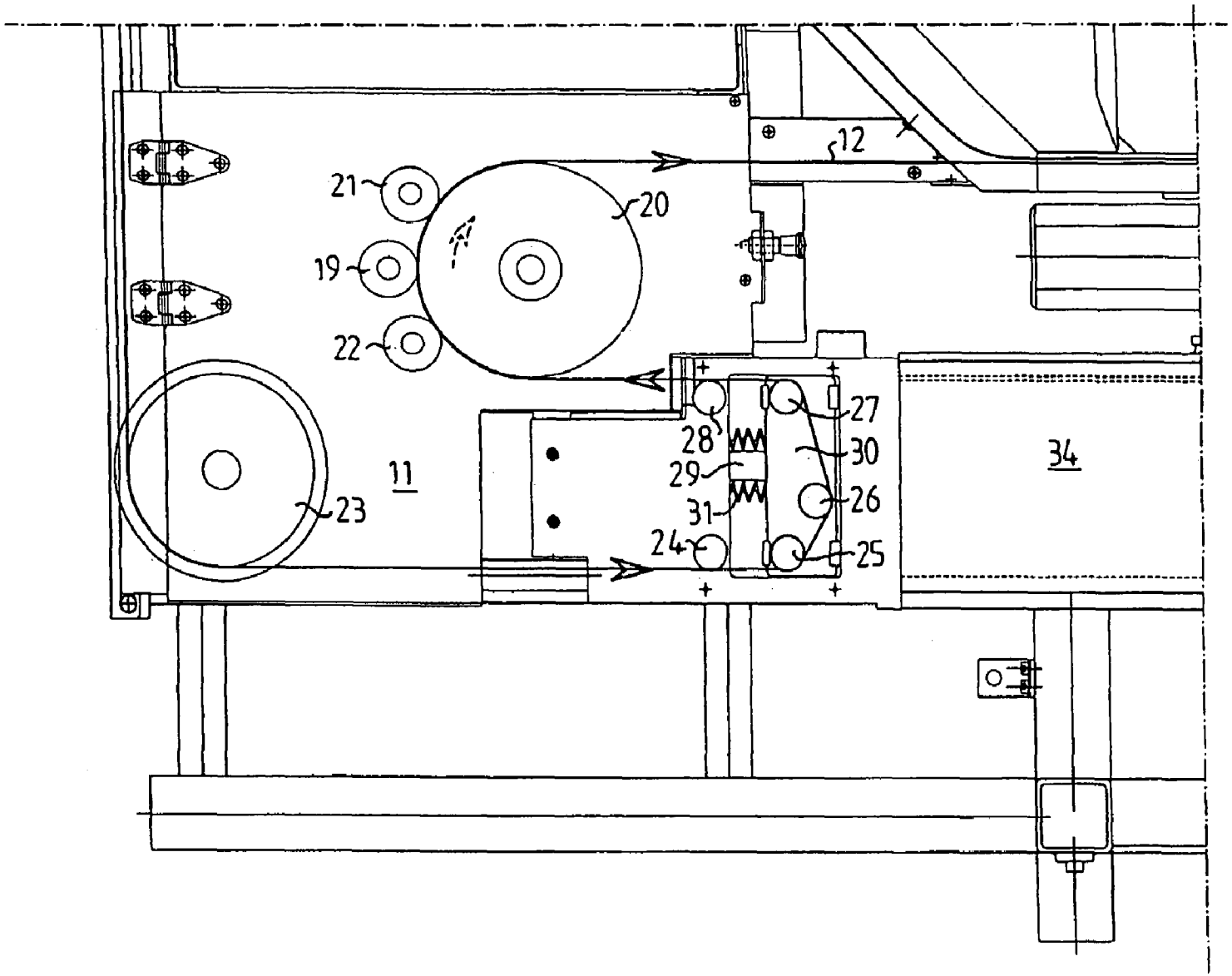
FIG. 3 is a side, elevational, partial, enlarged scale view of a feed unit shown in the machine of FIG. 1'

The feed unit 11 is shown in the Figures with its metal cover sheet removed, and it is shown on an enlarged scale in FIG. 3. It comprises a feed wheel, 20, which is driven by a reversible motor (not shown), and the wire, 12, is clamped against the feed wheel by counter-rolls, 19, 21, and 22, to ensure a frictional force against the wire. The wire is moved over a pulley 23 by means of a guide wheel 24 over three pulleys, 25, 26, and 27, and a guide wheel, 28, to the feed wheel, 20. The three pulleys, 25 through 27, are located on a block, 30, which is guided on a guide pin, 29, fixed on the stand, which guide pin is loaded by a spring, 31, towards an outer end position, and the wire tension will be counteracted by the spring force. The spring force is suitably adapted so that the block, 30, at normal wire tension is just in its outer end position. As the wire tension produces a resulting force on the block, 30, which is in parallel with and coaxial, or almost coaxial with the guide of the block, no breaking forces will affect the guide of the block.

Figure 2:
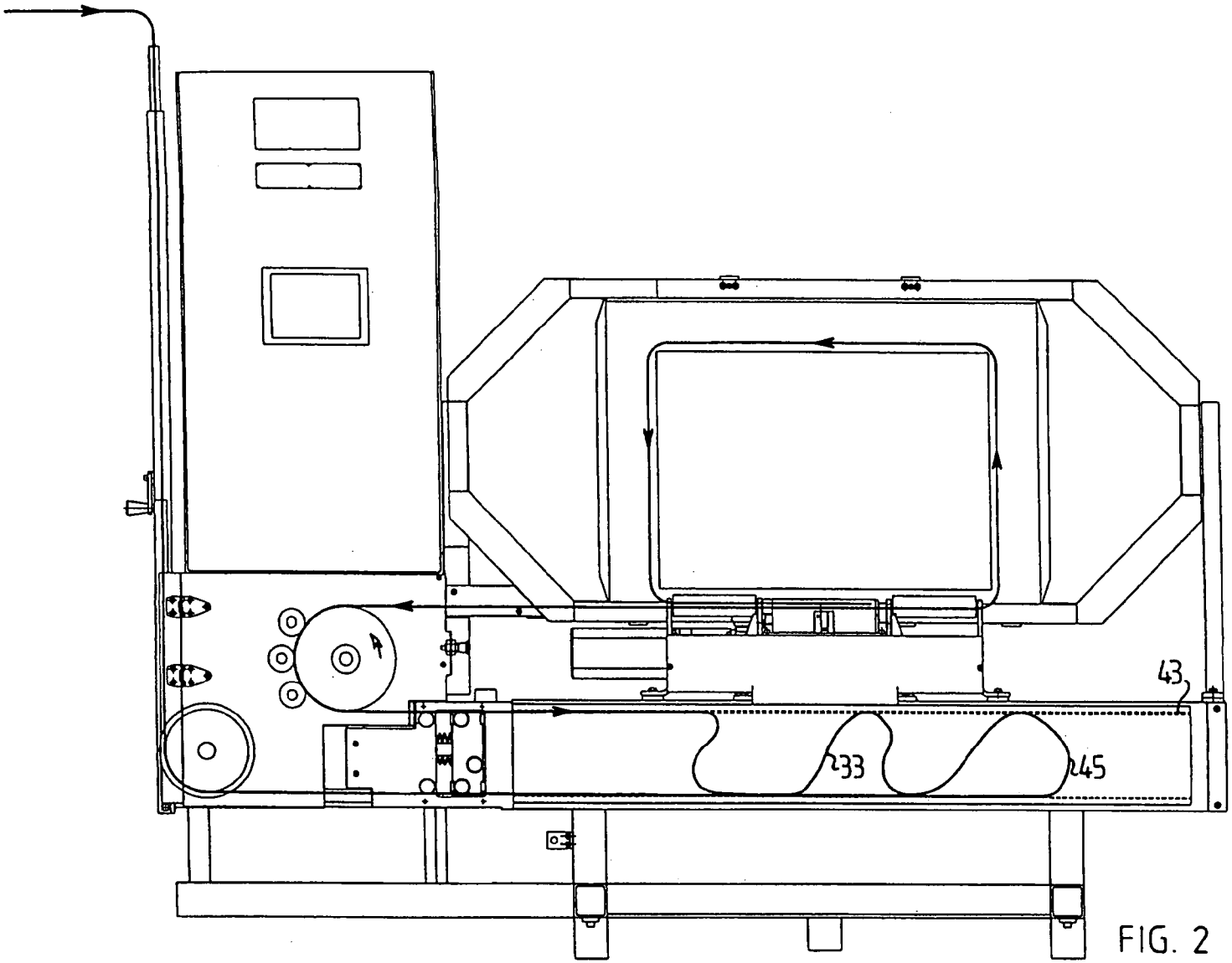
FIG. 2 is a side, elevational, partially opened view of the machine shown in FIG. 1 during wire stretching'

FIG. 1 shows the binding device during feeding of the wire, when the feed wheel, 20, has advanced the free end, 32, of the wire, 12, around the bale, 13, and the wire end is then guided by the guide bar, 14, so that it has returned to the binding unit, 17. The binding unit, 17, then catches the wire end, 32, and retains it. The wire guide bar, 14, is axially divisible and is opened so that the wire, 12, is released, and when the feed wheel, 20, is reversed, the wire will be stretched around the bale, 13, as shown in FIG. 2. When the wire, 12, is stretched, as shown in FIG. 2, the re-fed wire will be fed into a longitudinal horizontal or substantially horizontal wire take-up space, 34, which is a part of the wire take-up unit, 35. When the wire is stretched, the binding unit, 17, will cut off the wire and twist the ends into a knot.

Figure 5:
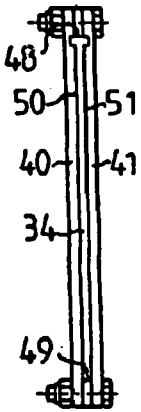
FIG. 5 is an end, elevational view of the wire take-up unit shown in FIG. 4.
Figure 4:
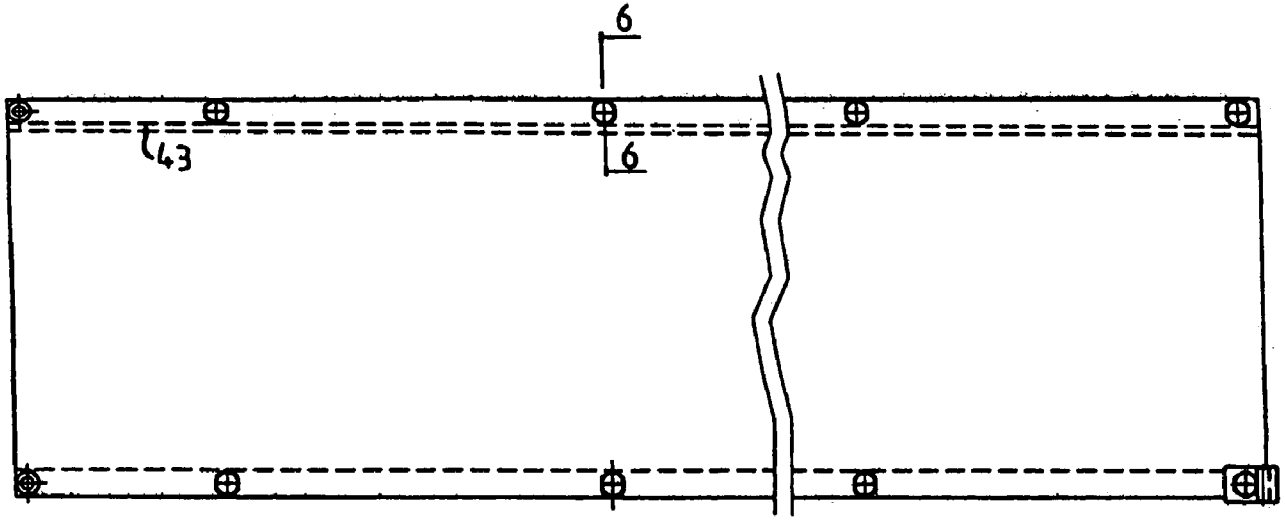
FIG. 4 is a side, elevational, enlarged view of a portion of the wire take-up unit shown in the machine shown in FIG. 1'
Figure 6:
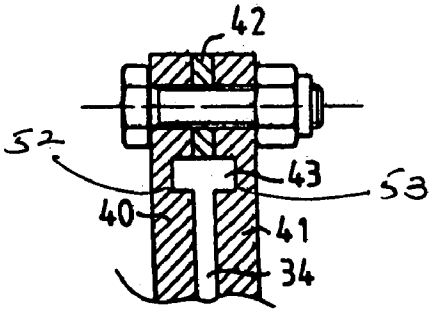
FIG. 6 is a side, elevational, sectional, partial view taken along line 6—6 in FIG. 4.

The wire take-up space, 34, is shown in FIG. 4 in a lateral view, and in FIG. 5 in an end view. The space is formed by two walls, 40 and 41 (suitably metal sheets), which are screwed together with a partition wall, 42, so that the space, 34, in cross-section has a substantially rectangular form with short sides, 48 and 49, and long sides, 50 and 51. The distance between the short sides, 48 and 49, (width) is slightly greater than the wire diameter D, as best shown in FIG. 6. The wire, therefore, cannot be wedged tightly between the walls, 40 and 41, or place itself double in width. The walls, 40 and 41, have at their ends (at the upper short side of the wire take-up space in the Figures) longitudinal grooves, 52 and 53, so that the wire take-up space, 34 is upwardly widened to a T-shape, and forms a wider portion, the wire guide space, 43, for the wire. The width of the wire guide space, 43, can be, for example, three wire diameters, where every groove, 52 and 53, in the walls, 40 and 41, has a depth of about one wire diameter. The wire guide space, 43, must not be too wide. It is suitable that the groove (52 and 53) has a width of fully one wire diameter, and depth of about 0.5 to 5 times the wire diameter or, still more suitably, about 1 to 2 times the wire diameter.

Figure 7:
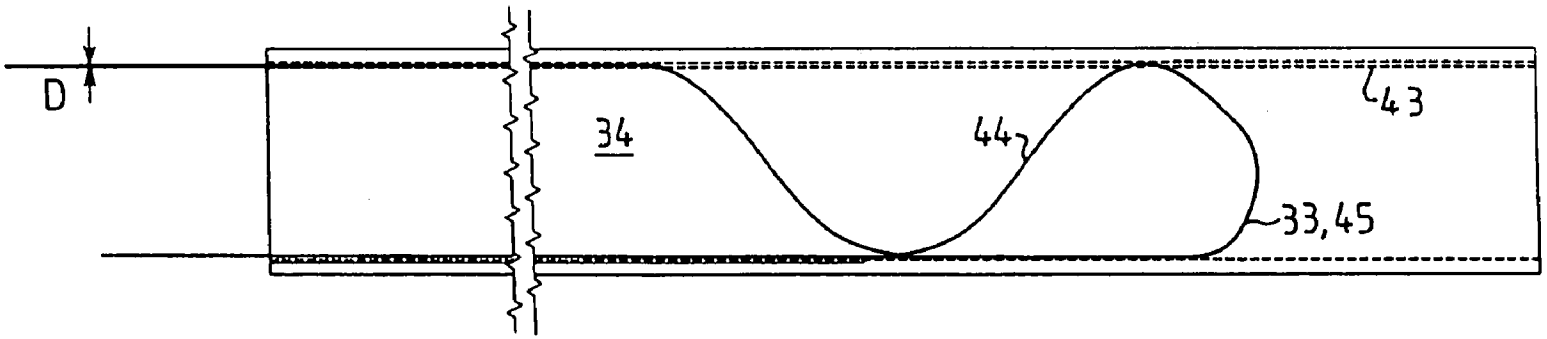
FIG. 7 is a side, elevational, enlarged, partial view of the take-up unit shown in FIG. 2, with the wire in a different position therefrom.

The wire guide space, 43, is located in its orientation so that the re-fed wire is fed into it. The wire sways slightly in the lateral direction when it is pressed into the grooves, 52 and 53, and therefore is retained in the wire guide space 43 a longer distance before it falls out of the grooves, 52 and 53, as a long soft bow, 44, to the lower short side, 49, of the wire take-up space, 34. Owing to the resilience of the steel wire, the leading edge of the loop, 33, does not collapse, but remains in a bow, 45, between the short sides, 48 and 49, of the wire take-up space, 34, as shown in FIG. 7. When the wire then continues to be fed into the space, 34, the bow, 44, will be pressed together forward, and at the same time a third loop is formed, as shown in FIG. 2. In this way the loops are stacked horizontally one after the other, and the wire take-up space, 34, can therefore receive along its entire length A a great wire length in relation to its size with no risk that the wire entangles or forms snarls or folds. The space, 34, must not be so high (have such a great distance between its short sides, 48 and 49), that a loop can be formed above another loop, i.e. the height must be adapted to the flexural resistance of the wire. The wire take-up space should have a length A sufficiently great that at least two loops can be formed one after the other in the wire take-up space, 34. The wire take-up space, of course, can be still longer in order to be able to take up more wire.

Suitable dimensions for the wire take-up space in a device according to the embodiment of the present invention shown with a wire diameter D of, for example, 2.2 mm can be a length A of about 1.5 m, distance between the short sides, 48 and 49, of about 0.2 m, distance between the long sides, 50 and 51, of about 3 mm, and a depth of the grooves, 52 and 53, of about 3 mm, and a width of about 3 mm.

For a device greater or smaller than the embodiment shown, of course, other measures are suitable and must, as mentioned above, be adapted to the wire diameter.

In the embodiment of the present invention shown herein, the wire guide space is a part of the upper portion of the wire take-up space. Depending on the design of the device, the wire guide space can be another part of the wire take-up space, for example a part of the lower portion of the wire take-up space.

Instead of having a longitudinal groove in each of the walls, only one wall can include one groove, where the wire take-up space is widened to an L-shape for forming the wire guide space.

The reliability of the take-up of wire in a device according to the present invention has proved to be considerably better than in known devices, and the taking-up allows a very high wire speed.

When a wire has been bound around the bale, as described above, the bale is advanced through a certain distance by the bale conveyor, 15, 16, for additional binding. The feed wheel 20 starts to feed the wire end once again, and at first the wire is taken from the earlier re-fed loop, 33, and the feed wheel, 20, comes up quickly to full feed speed which, for example, can be 4.5 m/s. When the loop ends and reaches the three pulleys, 25 through 27, on the block, 30, the wire will start to be drawn from the pulley, 23, and the idle wire starts to be accelerated up to the feed speed. When the jerk caused by the loop reaches the pulleys, 25 through 27, the spring, 31, will be compressed and thereby soften the jerk in the idle portion of the wire, so that it can be accelerated softly. The spring must not be prestressed and should have such a progressivity that the wire force can manage to break the return movement of the block, so that the block does not remain in its normal position, because this would involve the risk of snarls and knots in the wire, although the movement of the block, 30, when the end of the wire loop, 33, reaches the three pulleys, 25 through 27, of the block, reduces the risk thereof. By the resilient block, 30, the risk of the formation of snarls and knots in the wire is considerably reduced, and at the same time the strain on the feed wheel, 20, and its motor and possible gearbox is decreased, which can increase the service life of these parts.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. Apparatus for binding a supply of wire having a predetermined diameter around bales, a feeder for feeding and stretching said supply of wire, a guide for guiding said wire from said feeder around said bale, a wire cutter and twister for cutting said wire and twisting together the ends of said cut wire, and a take-up unit for taking up a loop in said wire obtained upon said stretching of said wire around said bale, said take-up unit comprising a longitudinally extending wire take-up space comprising a pair of long sides formed by a pair of walls and a pair of short sides, said pair of walls being separated by a first predetermined distance adapted to accept said wire having said predetermined diameter but not sufficient to accept a double strand of said wire, said pair of short sides separated by a second predetermined distance adapted to accept a loop of said wire without being folded, said longitudinally extending wire take-up space at one of said pair of short sides comprising a wire guide space which is wider than said first predetermined distance and formed by grooves in at least one of said pair of walls.

2. The apparatus of claim 1 wherein said wire take-up space has a substantially rectangular shape.

3. The apparatus of claim 1 wherein said bales comprise pulp bales.

4. The apparatus of claim 1 wherein said wire magazine comprises a coil of said wire.

5. The apparatus of claim 1 wherein said wire take-up space has a predetermined length sufficiently long to accommodate a plurality of successive wire loops therein.

6. The apparatus of claim 1 wherein said grooves in at least one of said pair of walls has a width approximately equal to said predetermined diameter and a depth of from about 0.5 to 1.5 times said predetermined diameter.

* * * * *